US007647004B2

(12) United States Patent
Mori

(10) Patent No.: US 7,647,004 B2
(45) Date of Patent: Jan. 12, 2010

(54) PROCESS CARTRIDGE, DEVELOPER CARTRIDGE, AND IMAGE FORMING DEVICE

(75) Inventor: Hiroki Mori, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 303 days.

(21) Appl. No.: 11/335,605

(22) Filed: Jan. 20, 2006

(65) Prior Publication Data

US 2006/0171738 A1 Aug. 3, 2006

(30) Foreign Application Priority Data

Jan. 28, 2005 (JP) ..... 2005-021991

(51) Int. Cl.
*G03G 21/16* (2006.01)

(52) U.S. Cl. ..... 399/111

(58) Field of Classification Search ..... 399/111–114
See application file for complete search history.

(56) References Cited

U.S. PATENT DOCUMENTS

| | | | | |
|---|---|---|---|---|
| 5,953,559 | A * | 9/1999 | Obu | 399/110 |
| 6,009,288 | A | 12/1999 | Akutsu | |
| 6,041,203 | A | 3/2000 | Suzuki et al. | |
| 6,330,410 | B1 | 12/2001 | Okabe et al. | |
| 6,411,789 | B1 | 6/2002 | Okabe et al. | |
| 6,546,217 | B2 | 4/2003 | Okabe et al. | |
| 6,690,903 | B2 | 2/2004 | Okabe et al. | |
| 6,807,381 | B2 * | 10/2004 | Sawano | 399/12 |
| 6,873,810 | B2 | 3/2005 | Okabe et al. | |
| 7,010,250 | B1 | 3/2006 | Yahagi | |
| 7,079,787 | B2 * | 7/2006 | Ogino et al. | 399/111 |
| 7,184,688 | B2 | 2/2007 | Ishii | |
| 2004/0117970 | A1 | 6/2004 | Ogino et al. | |
| 2005/0135837 | A1 | 6/2005 | Okabe et al. | |
| 2005/0147430 | A1 * | 7/2005 | Carter et al. | 399/113 |

FOREIGN PATENT DOCUMENTS

| | | |
|---|---|---|
| EP | 0 639 801 S1 | 2/1995 |
| EP | 1 103 865 A2 | 5/2001 |
| JP | A 04-246573 | 9/1992 |
| JP | A 07-215391 | 8/1995 |
| JP | A 11-224042 | 8/1999 |
| JP | A 2000-267547 | 9/2000 |
| JP | A 2001-44658 | 2/2001 |
| JP | A 2001-312112 | 11/2001 |
| JP | A 2004-018061 | 1/2004 |
| JP | A 2004-279704 | 10/2004 |

* cited by examiner

*Primary Examiner*—David M Gray
*Assistant Examiner*—Erika Villaluna
(74) *Attorney, Agent, or Firm*—Oliff & Berridge, PLC

(57) ABSTRACT

A developer cartridge includes a first developer wall formed with a convex part and a second developer wall disposed in confronting relation with the first developer wall. The convex part of the first developer wall is insertable into an insertion portion of an image-bearing member cartridge when the developer cartridge is mounted on the image-bearing member cartridge. When a plurality of the developer cartridges are stacked one on the other with the first developer wall being downside with respect to the second developer wall facing upward, the first developer engagement part in one developer cartridge engages the second developer engagement part in another developer cartridge disposed just below the one developer cartridge.

11 Claims, 12 Drawing Sheets

PROCESS CARTRIDGE, DEVELOPER CARTRIDGE, AND IMAGE FORMING DEVICE

CROSS REFERENCE TO RELATED APPLICATION

This application claims priority from Japanese Patent Application No. 2005-021991, filed Jan. 28, 2005, the contents of which are hereby incorporated by reference into the present application.

TECHNICAL FIELD

The disclosure relates to an image forming device such as a laser printer, and a process cartridge and a developer cartridge which are, in use, mounted on the image forming device.

BACKGROUND

Conventional image forming devices such as a laser printer use a photosensitive cartridge in which a photosensitive drum is rotatably supported. A developer cartridge is also used therein for supplying the photosensitive drum with toner. The photosensitive cartridge and the developer cartridge are mountable to and detachable from the main body of the device. Only necessary one or ones of the cartridges can be replaced with a new one when the lifetime of the cartridge is ended.

Japanese Patent Application Publication No. 2000-267547 discloses a photosensitive cartridge, for use in an image forming device. The photosensitive cartridge has a flat lower surface facilitating to place the cartridge removed from the image forming device on a flat table.

With the photosensitive cartridge according to the proposal described above, the cartridge can be placed stably on a flat plane. However, the shape of the upper surface of the cartridge does not allow another photosensitive cartridge to be stacked thereon. Typically, a manufacturer collects and stores, in a stock room, old photosensitive cartridges or developer cartridges detached from the main body of the device for recycling In this case, it is convenient if the cartridges can be stacked one on the other. Otherwise, inconvenience is caused in handling the old cartridges and a large space is required for storage.

SUMMARY

In view of the foregoing, it is an object of the present invention to provide a process cartridge and a developer cartridge which can be stacked stably, without packing the cartridges in boxes, and an image forming device including such a process cartridge or developer cartridge.

In order to attain the above and other objects, the present invention provides a process cartridge being detachably mountable in an image-forming device. The process cartridge includes a main casing. The main casing includes a first wall, a second wall, and a third wall. The first wall is formed with at least one first engagement part. The second wall is formed with at least one second engagement part. The second wall is disposed in confronting relation with the first wall. The third wall connects the first wall and the second wall. When a plurality of the process cartridges are stacked one on the other with the first wall being downside with respect to the second wall, the first engagement part in one process cartridge engages the second engagement part in another process cartridge disposed just below the one process cartridge.

According to another aspect of the present invention provides a developer cartridge, detachably mountable in an image-bearing member cartridge. The developer cartridge includes a developer main casing. The developer main casing includes a first developer wall and a second developer wall. The first developer wall is formed with a convex part. The second developer wall is formed with an insertion portion inserted by the convex part when the developer cartridge is mounted on the image-bearing member cartridge. The second developer wall is disposed in confronting relation with the first developer wall.

According to another aspect of the present invention provides a developer cartridge being detachably mountable in an image-bearing member cartridge. The developer cartridge includes a developer main casing. The developer main casing includes a first developer wall and a second developer wall. The first developer wall is formed with a first developer engagement part. The second developer wall is formed with a second developer engagement part. The second developer wall is disposed in confronting relation with the first developer wall. When a plurality of the developer cartridges are stacked one on the other with the first developer wall being downside with respect to the second developer wall facing upward, the first developer engagement part in one process cartridge engages the second developer engagement part in another developer cartridge disposed just below the one developer cartridge.

According to another aspect, of the present invention provides an image-forming device. The image-forming device includes a process cartridge. The process cartridge includes a main casing. The main casing includes a first wall, a second wall, and a third wall. The first wall is formed with at least one first engagement part. The second wall is formed with at least one second engagement part. The second wall is disposed in confronting relation with the first wall. The third wall connects the first wall and the second wall. When a plurality of the process cartridges are stacked one on the other with the first wall being downside with respect to the second wall, the first engagement part in one process cartridge engages the second engagement part in another process cartridge disposed just below the one process cartridge.

According to another aspect of the present invention provides an image-forming device. The image-forming device includes a developer cartridge being detachably mountable in an image-bearing member cartridge. The developer cartridge includes a developer main casing. The developer main casing includes a first developer wall and a second developer wall. The first developer wall is formed with a convex part. The second developer wall is formed with an insertion portion into which the convex part is inserted when the developer cartridge is mounted on the image-bearing member cartridge. The second developer wall is disposed in confronting relation with the first developer wall.

DETAILED DESCRIPTION OF THE PREFERRED EMBODIMENTS

Figure 1:
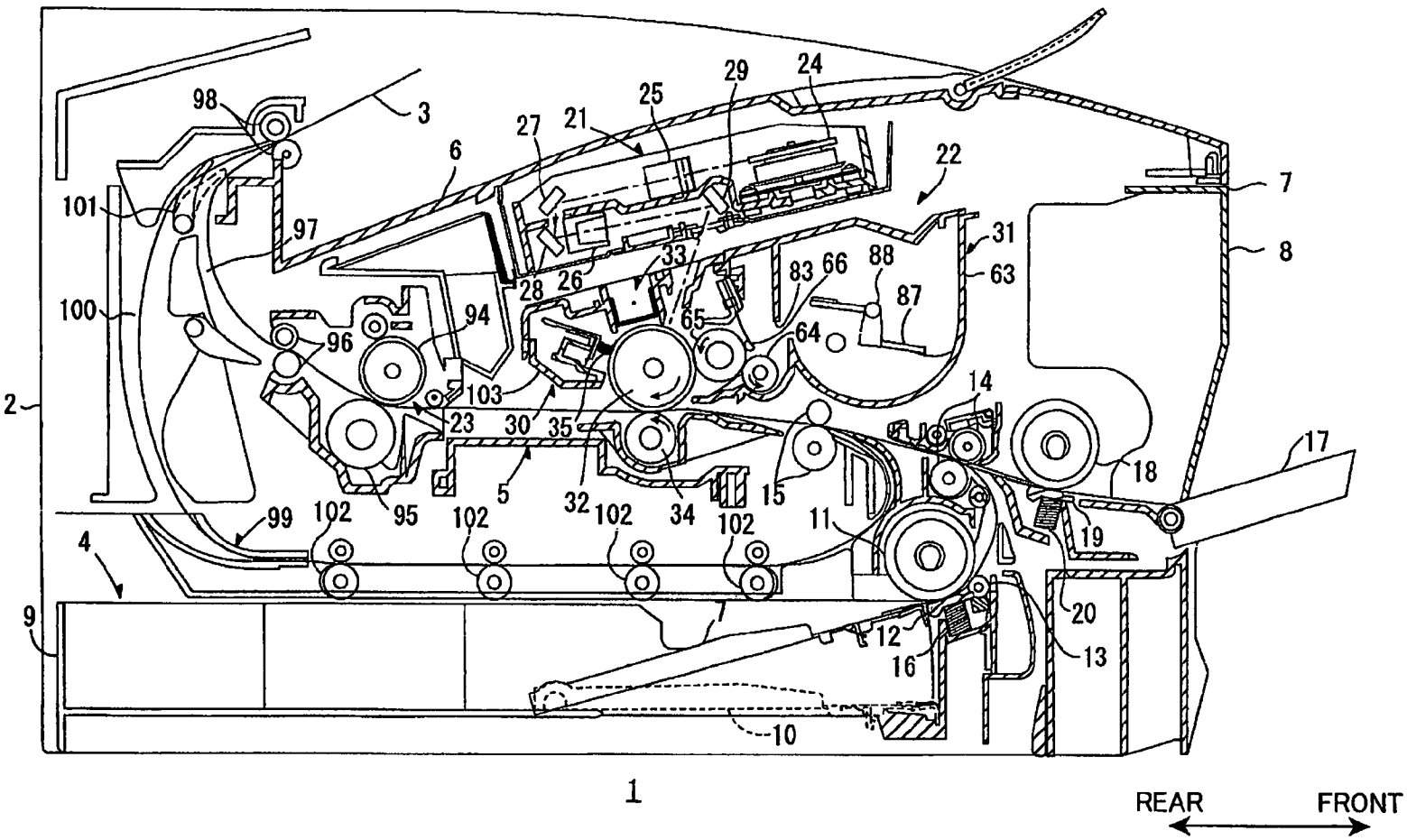
FIG. 1 is a side cross-sectional view of a main part of a laser printer according to a preferred embodiment of the present invention.

A preferred embodiment of the present invention will be described while referring to the accompanying drawings wherein like parts and components are designated by the same reference numerals to avoid duplicating description.

<Overall Structure of Laser Printer>

FIG. 1 is a side cross-sectional view showing a laser printer as an image forming device according to an embodiment of the present invention. In FIG. 1, the laser printer 1 has a feeder section 4 and an image forming section 5, in a body casing 2. The feeder section 4 serves to feed a paper sheet 3 as a recording medium. The image forming section 5 serves to form an image on the paper sheet 3.

<Structure of Body Casing 2>

A sheet discharge tray 6 for receiving the paper sheet 3 on which an image has been formed is formed on the upper surface of the body casing 2. On one side of the sheet discharge tray 6, an operation panel having operation keys, and an LED display portion are provided. Further, an opening 7 through which a process cartridge 22 to be described in detail is detachably mounted is formed on the side wall at the operation panel side in the body casing 2. A front cover 8 is provided for opening and closing the opening 7. The front cover 8 is pivotably movably supported by a cover shaft (not shown) inserted in a lower end portion of the front cover 8. The front cover 8 is pivotably moved to selectively open and close the opening. Specifically when the front cover 8 is opened (tilted), the opening 7 is opened whereas when the front cover 8 is closed, the opening 7 is closed. Through the opening 7, the process cartridge 22 can be mounted on and detached from the body casing 2.

In the description below, the side in which the front cover is provided is defined as the "front side" of this laser printer 1, and the opposite side is as the "rear side". The direction perpendicular to sheet of drawing in FIG. 1 is defined as the widthwise direction of the laser printer 1.

<Structure of Feeder Section>

The feeder section 4 includes a sheet feed tray 9, a sheet press plate 10, a sheet feed roller 11, a sheet feed pad 12, paper powder removal rollers 13 and 14, and registration rollers 15. The sheet feed tray 9 is detachably mounted on a bottom portion of the body casing 2. The sheet press plate 10 is provided in the sheet feed tray 9. The sheet feed roller 11 and sheet feed pad 12 are provided in the front and upper side of the sheet feed tray 9. The paper powder removal roller 13 is disposed in opposition to the sheet feed roller 11 with the paper sheet conveying path intervened therebetween. Another paper powder removal rollers 14 are disposed in the downstream side of the sheet feed roller 11 in the conveying direction of a paper sheet 3. The registration rollers 15 are disposed in the downstream side of the paper powder removal rollers 13 and 14 in the conveying direction of the paper sheet 3.

The sheet press plate 10 adapted to receive paper sheets 3 to be stacked thereon. When the paper sheets 3 are stacked on the sheet press plate 10, an end portion of the sheet press plate 10 moves away from the sheet feed roller 11. The sheet press plate 10 is urged upwardly by a spring (not shown) from the back side thereof. Therefore, as the number of stacked paper sheets 3 increases, the sheet press plate 10 is moved downwardly against the pressing force of the spring. The sheet feed roller 11 is disposed in confronting relation with the sheet feed pad 12. The sheet feed pad 12 is pressed against the sheet feed roller 11 by a spring 16 provided on the back side of sheet feed pad 12.

The paper sheet 3 stacked at the uppermost position on the sheet press plate 10 is pressed against the sheet feed roller 11 by the pressing force of the spring from the back side of the sheet press plate 10. The uppermost paper sheet 3 is sandwiched between the sheet feed roller 11 and the sheet feed pad 12 and fed by rotation of the sheet feed roller 11 upon being separated from the remaining paper sheets 3.

Further, paper powder is removed by the paper powder removal rollers 13 and 14. Thereafter, the paper sheet 3 is conveyed by the registration rollers 15.

The registration rollers 15 consist of a pair of rollers opposed to each other. After registration of the paper sheet 3 is completed, the registration rollers 15 convey the paper sheet 3 to a transfer position between a photosensitive drum 32 and a transfer roller 34 where a toner image on the photosensitive drum 32 is transferred to the paper sheet 3.

The feeder section 4 further includes a multipurpose tray 17, a multipurpose tray side sheet feed roller 18, and a multipurpose tray side sheet feed pad 19. The multipurpose tray side sheet feed roller 18 and multipurpose tray side sheet feed pad 19 serve to feed paper sheets 3 stacked on the multipurpose tray 17. The multipurpose tray side sheet feed roller 18 and the multipurpose tray side sheet feed pad 19 are disposed in opposition to each other. The multipurpose tray side sheet feed pad 19 is pressed toward the multipurpose tray side sheet feed roller 18 by a spring 20 provided in the back side of the multipurpose tray side sheet feed pad 19.

The paper sheets 3 stacked on the multipurpose tray 17 are separated one after another and fed into a nip between the multipurpose tray side sheet feed roller 18 and the multipurpose tray side sheet feed pad 19. The paper sheet 3 is fed by rotation of the multipurpose tray side sheet feed roller 18.

<Structure of Image Forming Section>

The image forming section 5 includes a scanner section 21, a process cartridge 22, a fixing section 23.

<Structure of Scanner Section>

The scanner section 21 is disposed at an upper portion inside the body casing 2. The scanner section 21 includes a laser light emission section (not shown), a polygon mirror 24, lenses 25 and 26, and reflection mirrors 27, 28, and 29. A laser beam modulated based on image data emitted from the laser light emission section. Then the modulated laser beam is reflected by the polygon mirror 24, passes through the lens 25, and reflected by or passes through reflection mirrors 27 and 28, lens 26, and reflection mirror 29 in this order, as indicated by a chain line in FIG. 1. The laser beam is thus irradiated onto the surface of the photosensitive drum 32 contained in the process cartridge 22.

<Structure of Process Cartridge>

Figure 2:
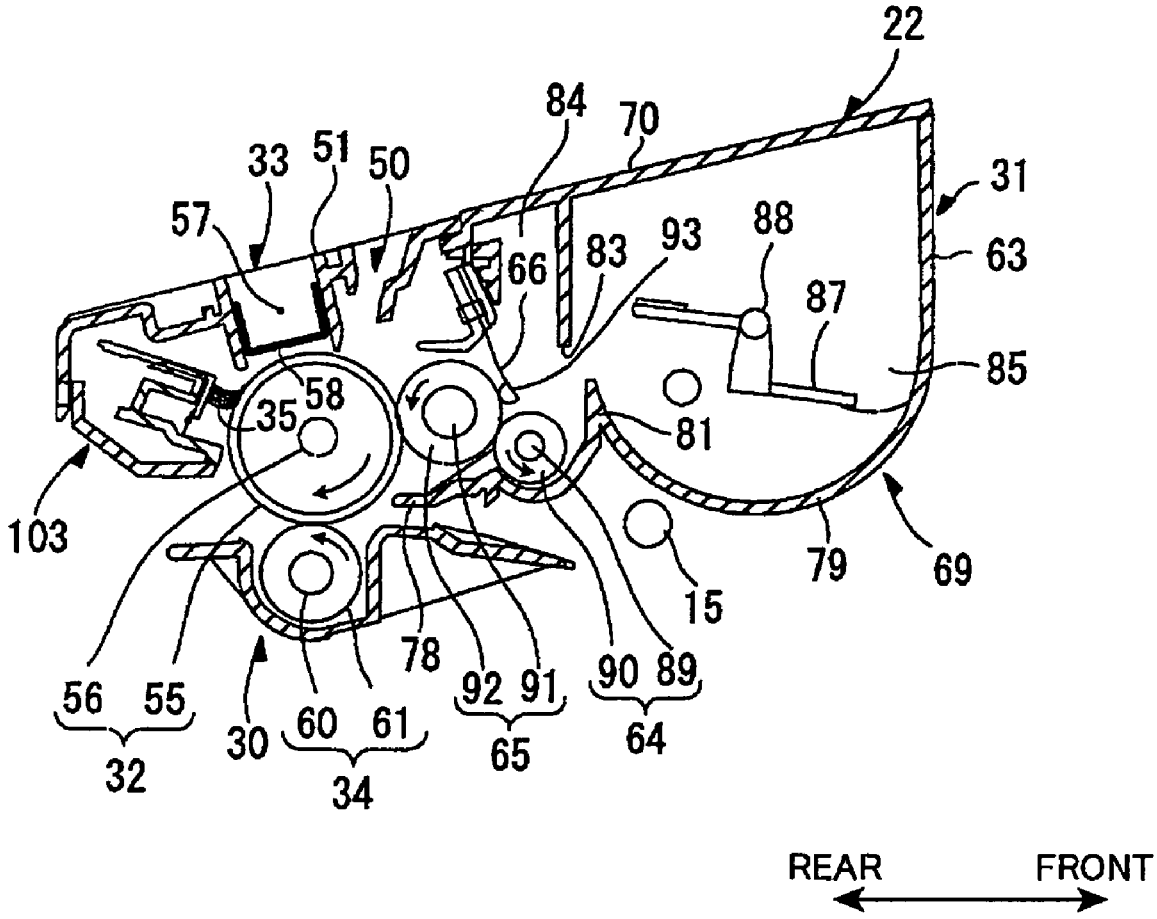
FIG. 2 is a side cross-sectional view of a process cartridge shown in FIG. 1.

FIG. 2 is a side cross-sectional view of the process cartridge 22.

The process cartridge 22 is detachably mounted on the body casing 2 and disposed below the scanner section 21. This process cartridge 22 includes a drum cartridge 30, and a developer cartridge 31 which is detachably mounted on the drum cartridge 30.

<Structure of Drum Cartridge>

As shown in FIG. 2, the drum cartridge 30 includes a cartridge frame 103, a photosensitive drum 32 disposed in the cartridge frame 103, a scorotron charger 33, a transfer roller 34, and a cleaning brush 35.

Figure 3:
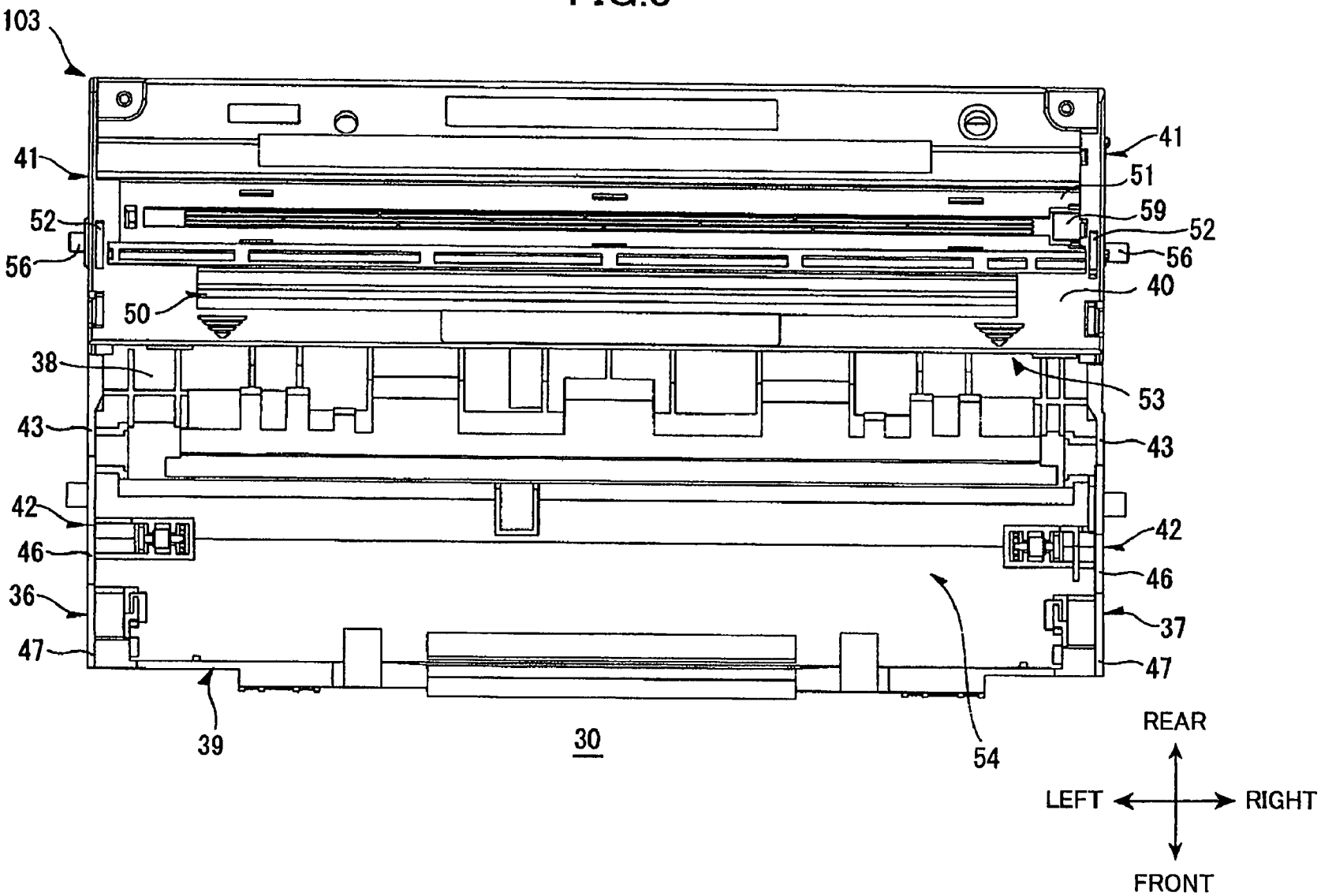
FIG. 3 is a plan view of a drum cartridge shown in FIG. 1.
Figure 4:
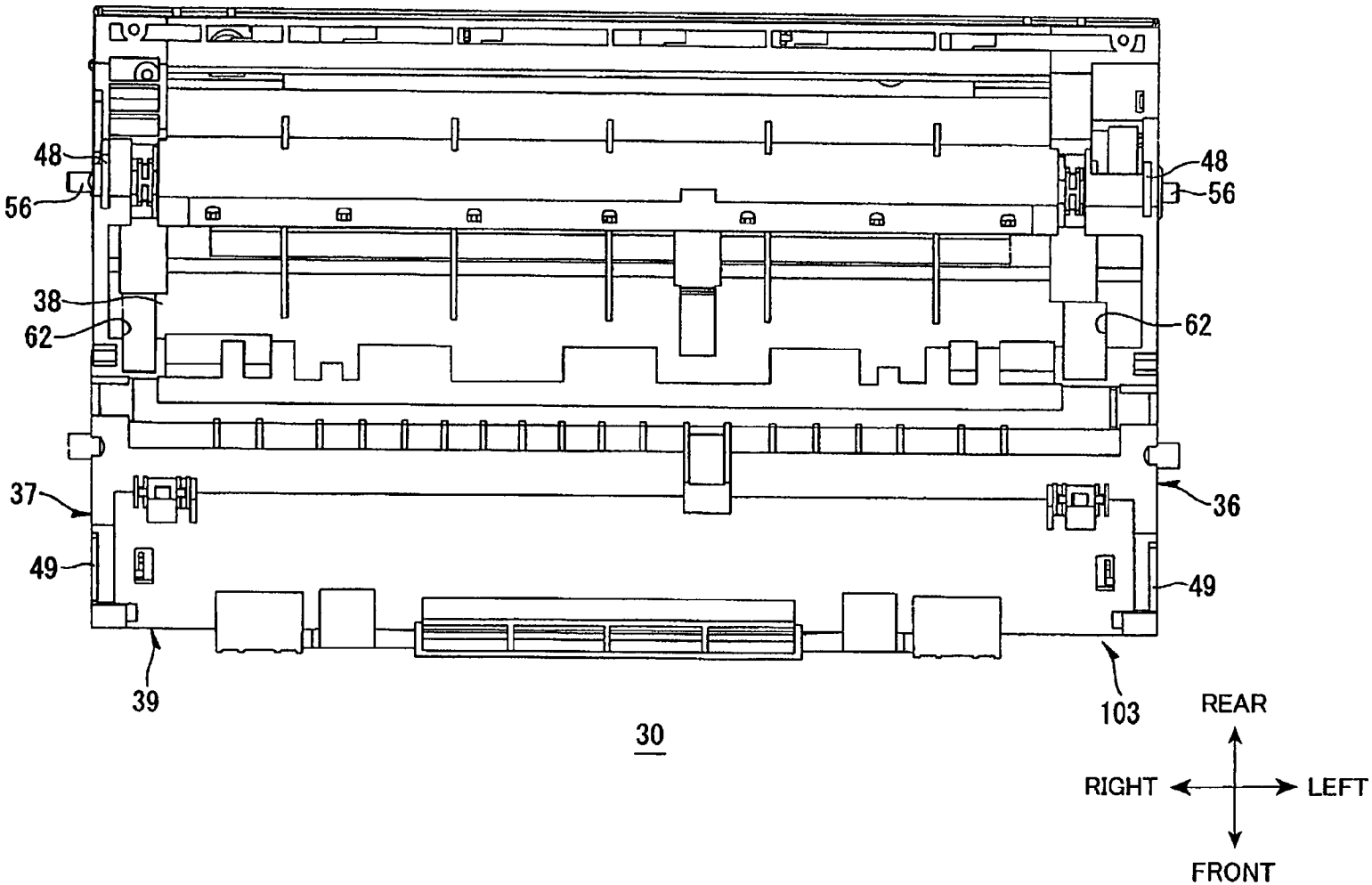
FIG. 4 is a bottom view of the drum cartridge shown in FIG. 1.
Figure 5:
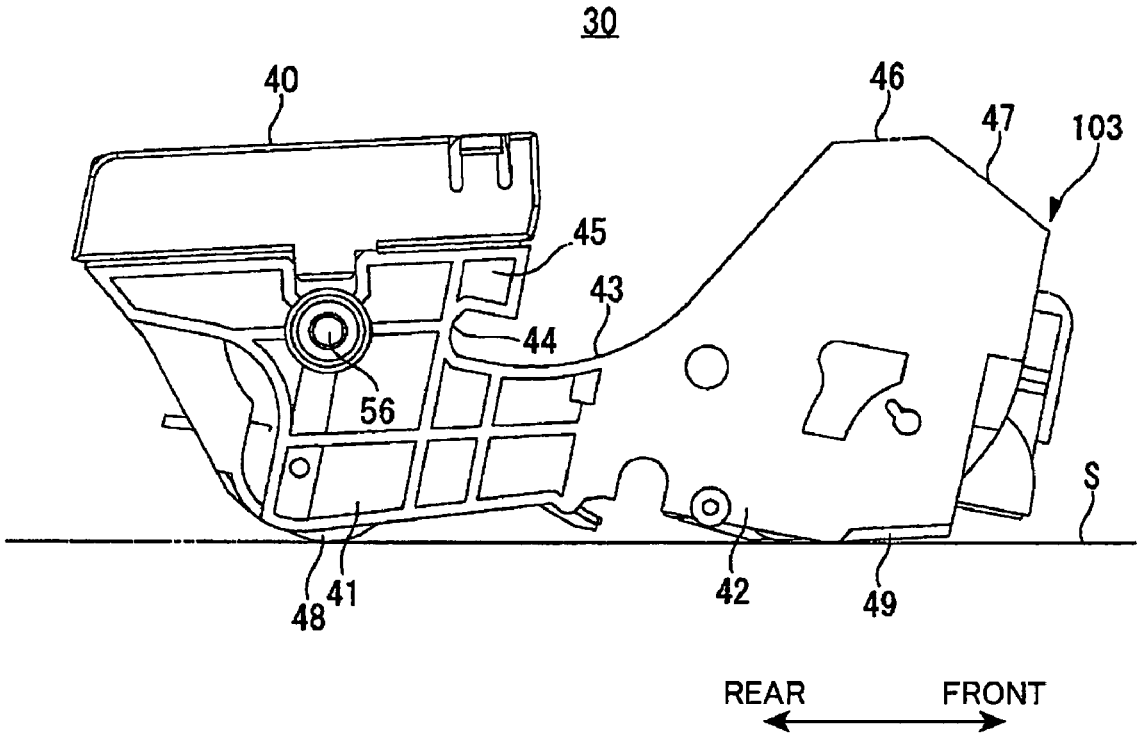
FIG. 5 is a side view of the drum cartridge shown in FIG. 1.

FIG. 3 is a plan view of a drum cartridge 30. FIG. 4 is a bottom view of the drum cartridge 30. FIG. 5 is a side view of the drum cartridge 30.

As shown in FIG. 3, a cartridge frame 103 integrally has a left side wall 36, a right side wall 37, a bottom wall 38, a front wall 39, and a rear upper wall 40.

The left side wall 36 and the right side wall 37 are opposed to each other with an interval in the widthwise direction therebetween. Further, the left side wall 36 and the right side wall 37 have substantially symmetrical structures in the widthwise direction. As shown in FIG. 5, each of the left side wall 36 and right side wall 37 has a rear side wall portion 41 having a substantially bow-side like shape when viewed from a side, and a front side wall portion 42 extending frontwardly from the rear side wall portion 41.

In the front side wall portion 42, a roller shaft guide portion 43, and a roller shaft receiving portion 44 are formed. The roller shaft guide portion 43 guides a shaft end portion of a developer roller shaft 91 described later when the developer cartridge 31 is attached to the drum cartridge 30. The roller shaft receiving portion 44 is formed continuously with a rear end of the roller shaft guide portion 43, and receives the end portion of the developer roller shaft 91 guided by the roller shaft guide portion 43.

The roller shaft guide portion 43 is formed as a part of an upper end edge of the front side wall portion 42. That is, the roller shaft guide portion 43 extends obliquely downwardly toward the rear side from the middle of the front side wall portion 42. The roller shaft guide portion 43 is downwardly shaped and gradually flattened toward the rear side.

The roller shaft receiving portion 44 is formed below a protruding wall 45 and continuous to the rear side of the roller shaft guide portion 43. The roller shaft receiving portion 44 is a substantially in a rectangular shape when viewed from a side. A lower end edge of the protruding wall 45 is formed continuously with the rear end edge of the roller shaft guide portion 43.

Also, the front side wall portion 42 has a front engagement convex portion 46. When plural drum cartridges 30 are stacked one on the other, the front engagement convex portion 46 of the lower drum cartridge 30 is engageable with a front engagement concave portion 49 of the upper drum cartridge 30, described later This front engagement convex portion 46 is flat at the top and formed as a part of the upper end edge of the front side wall portion 42. Further, the upper front end portion 47 of the front side wall portion 42 extends obliquely downwardly toward the front side, the front engagement convex portion 46 is higher than the top flat portion of the front end portion 47 and the roller shaft guide portion 43.

As shown in FIG. 3, the bottom wall 38 is substantially flat in shape, and is provided to connect lower end edges of the left side wall 36 and the right side wall 37 in the front-to-rear direction. As shown in FIGS. 4 and 5, the bottom wall 38 has a pair of rear engagement convex portions 48, at a position below the drum shaft 56 of a photosensitive drum 32 and right and left side end portions. When plural drum cartridges 30 are stacked one on the other, the rear engagement convex portions 48 are engaged with (inserted in) rear engagement concave portions 52 (described later) of an upper drum cartridge 30. Each of the rear engagement convex portions 48 is formed of a thin plate which is curved to protrude downwardly. When a drum cartridge 30 is put on a flat mount surface S, each of the rear engagement convex portions 48 contacts the mount surface S, and supports the drum cartridge 30 such that the rear upper wall 40 and the front engagement convex portion 46 are substantially parallel to the mount surface S.

Also, a pair of front engagement concave portions 49 is formed in the bottom wall 38 at positions opposed in the widthwise direction. When plural drum cartridges 30 are stacked one on the other, the front engagement concave portions 49 are engaged with (receive) the front engagement convex portions 46 of an upper drum cartridge 30. The front engagement concave portion 49 is substantially in a rectangular shape when viewed from the bottom.

Further, as shown in FIG. 4, a pair of insertion portions 62 is formed at the left and right side end portions of the bottom wall 38. When a plurality of the drum cartridge 30 is stacked one on the other, the developer engagement convex portion 80, described later, of the lower drum cartridge 30 can be inserted in the insertion portion 62 of upper drum cartridge 30. Each of the insertion portions 62 is provided at a position near the center with respect to the front-to-rear direction, ie., between the rear engagement convex portion 48 and the front engagement concave portion 49. The insertion portions 62 are in the form of a through-hole having a substantially rectangular shape when viewed from the bottom.

The front wall 39 is bent upwardly from the front end edge of the bottom wall 38. This front wall 39 is substantially in a rectangular shape. Both end portions of the front wall 39 in the widthwise direction are bent perpendicularly and are formed continuously with the left side wall 36 and right side wall 37.

As shown in FIGS. 3 and 5, the rear upper wall 40 is a flat, plate-like member and is provided so as to connect to the upper end edges of the rear side wall portions 41 of the left side wall 36 and the right side wall 37. At the front portion of the rear upper wall 40, a laser input window 50 is formed which is substantially rectangular in shape when viewed from the top extends in the widthwise direction, as shown in FIG. 3. The rear upper wall 40 has a charger support portion 51 for supporting a Scorotron charger 33, which is disposed behind the laser input window 50.

Further, in the rear upper wall 40, a pair of rear engagement concave portions 52 is formed. When plural drum cartridges 30 are stacked one on the other, the pair of rear engagement concave portions 52 of the lower drum cartridge 30 is engageable with the pair of the rear engagement convex portions 48 at the left and right side end portions of the rear upper wall 40 of the upper drum cartridge 30. Each of the rear engagement concave portions 52 is provided at a position opposed in the vertical direction to the rear engagement convex portions 48.

Further, in the cartridge frame 103, a drum accommodating section 53 which accommodates the photosensitive drum 32, is formed by the rear side wall portions 41 of the left and right side walls 36 and 37, the rear upper wall 40, and the rear portion of the bottom wall 38 which is opposed in the vertical direction to the rear upper wall 40. The drum accommodating section 53 is open to the front. A developer cartridge accommodating section 54 which accommodates the developer cartridge 31 is formed by the front side wall portions 42 of the left and right side walls 36 and 37, and the front portion of the bottom wall 38 formed continuously with each of the front side wall portions 42 in the widthwise direction. The developer cartridge accommodating section 54 is open in the upper side and communicates with the drum accommodating section 53 in the rear side.

As shown in FIG. 2, the photosensitive drum 32 has a cylindrical drum body 55 and a metal-made drum shaft 56. The drum body 55 is formed of a photosensitive layer having positive charges. A surface layer of the drum body 55 is made of polycarbonate. The drum shaft 56 extends in the longitudinal direction of the drum body 55 through the center of the drum body 55 to be loosely rotatable about the drum body 55. The drum shaft 56 is fixedly supported by the left and right side walls 36 and 37 of the drum cartridge 30. Thus, the photosensitive drum 32, disposed between the left and the right side walls 36 and 37 is rotatable around the drum shaft 56.

The Scorotron charger 33 is disposed above the photosensitive drum 32 and supported by the charger support portion 51. The Scorotron charger 33 is disposed opposite to the photosensitive drum 32 without contacting each other. A predetermined interval is maintained between the Scorotron charger 33 and the photosensitive drum 32. This Scorotron charger 33 has a wire 57, grid 58, and a wire cleaner 59.

The wire 57 is stretched between the left and right side walls 36 and 37 while imparting a predetermined tension therebetween.

The grid 58 extends in the widthwise direction to surround the lower side of the wire 57. The grid 58 is bridged between the left and right side walls 36 and 37.

A wire cleaner 59 (see FIG. 3) is provided to be slidably movable in the widthwise direction of the charger support portion 51, while sandwiching and contacting the wire 57. The sliding movement of the wire cleaner 59 cleans the wire 57.

A transfer roller 34 is rotatably supported between the left and right side walls 36 and 37. As shown in FIG. 2, the transfer roller 34 is opposed to and contacts the photosensitive drum 32, thereby forming a nip between the transfer roller 34 and the photosensitive drum 32. This transfer roller 34 includes a transfer roller shaft 60 made of metal, and a roller 61 made of a conductive rubber material.

A cleaning brush 35 is disposed at the rear side of the photosensitive drum 32. A lot of bristles of the cleaning brush 35 are supported on a support plate having an elongated rectangular shape extending in the widthwise direction. The cleaning brush 35 is opposed to the photosensitive drum 32 in the front-to-rear direction, such that the bristles contact the surface of the photosensitive drum 32 along the widthwise direction.

<Structure of Developer Cartridge>

Figure 6:
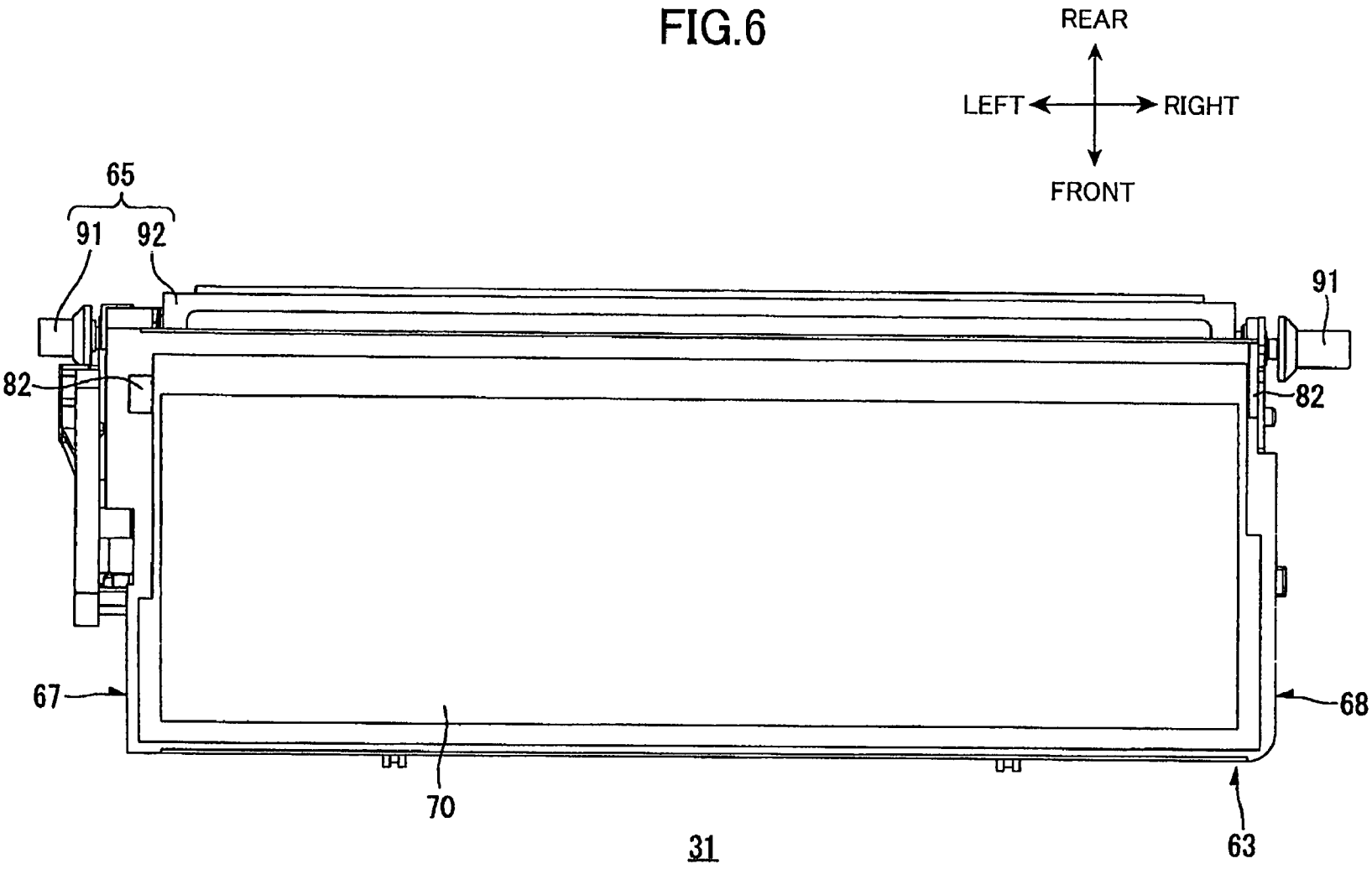
FIG. 6 is a plan view of a developer cartridge shown in FIG. 1.
Figure 7:
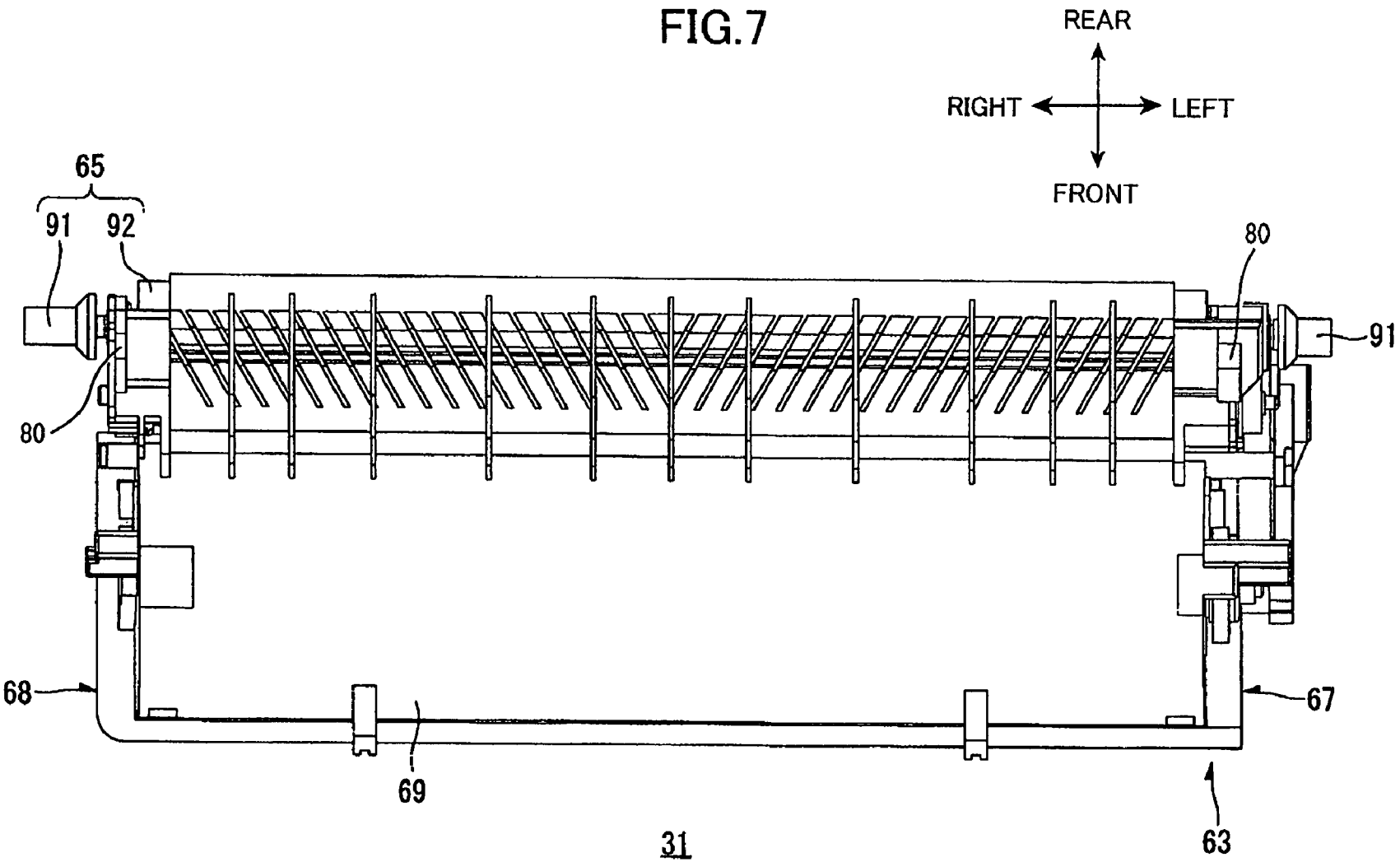
FIG. 7 is a bottom view of the developer cartridge shown in FIG. 1.
Figure 8:
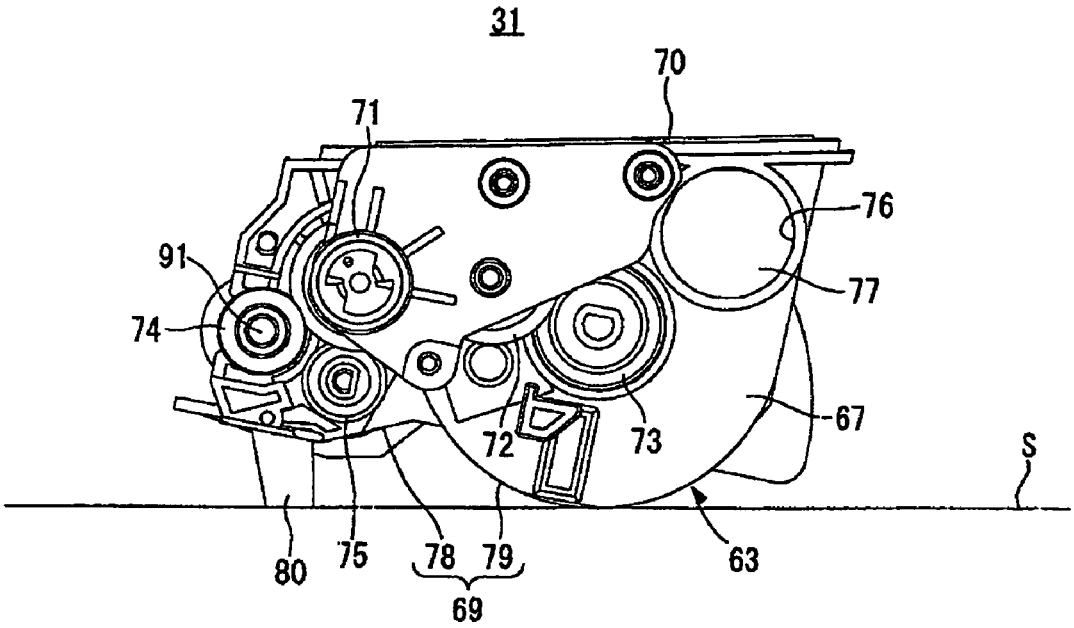
FIG. 8 is a side view of the developer cartridge shown in FIG. 1.

FIG. 6 is a plan view of the developer cartridge 31. FIG. 7 is a bottom view of the developer cartridge 31. FIG. 8 is a side view of the developer cartridge 31.

The developer cartridge 31 is detachably mounted in the developer cartridge accommodating section 54. As shown in FIG. 2, the developer cartridge 31 includes a box-like developer casing 63 open in the rear side, a feed roller 64, a developer roller 65, and a layer-thickness regulation blade 66.

Figure 9:
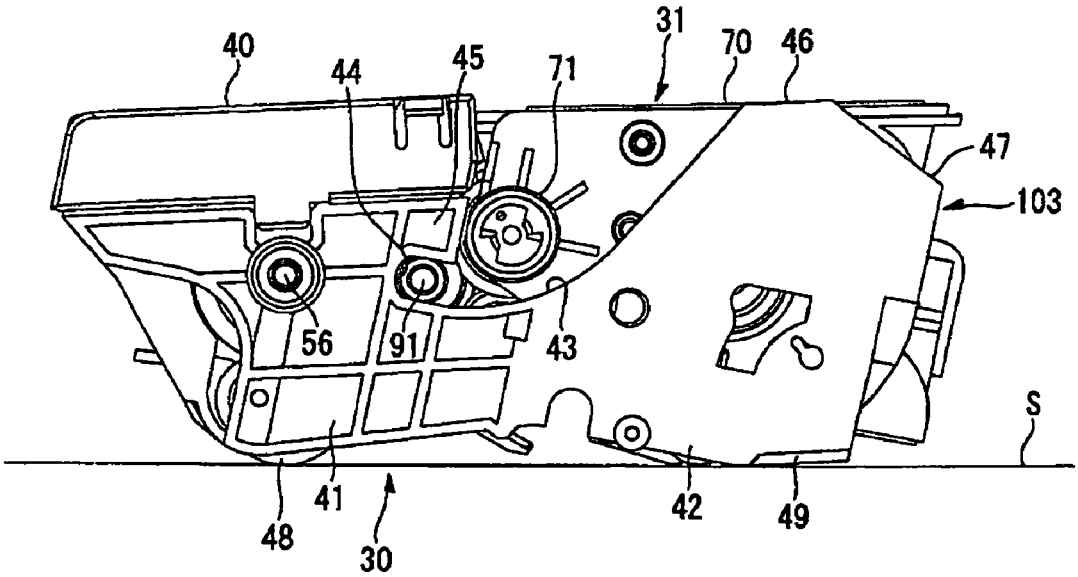
FIG. 9 is a side view of the process cartridge shown in FIG. 1 when the developer cartridge is mounted on the drum cartridge.

As shown in FIGS. 6 and 7, the developer casing 63 is defined by a left side wall 67, a right side wall 68, a lower wall 69, and an upper wall 70. The left side wall 67 and the right side wall 68 are disposed opposed to each other, with an interval therebetween in the widthwise direction. The lower wall 69 and the upper wall 70 are connected to the left and right side walls 67 and 68. As shown in FIG. 9, when the developer cartridge 31 is mounted in the developer cartridge accommodating section 54 of the drum cartridge 30 and the drum cartridge 30 on which the developer cartridge 31 is mounted is put on the mount surface S, the upper surface (upper wall 70) is held substantially at the same height as the upper surface of the rear upper wall 40.

The left and right side walls 67 and 68 are in a plate-like shape extending in the front-to-rear direction. The upper wall 70 is bridged between upper end edges of both walls. The left and right side walls 67 and 68 sandwich the lower wall 69, and are provided such that inner surfaces of the walls 67 and 68 are opposed to each other.

As shown in FIG. 8, the left side wall 67 is provided with an intermediate gear 72, an agitator drive gear 73, a developer roller drive gear 74, and a feed roller drive gear 75. The intermediate gear 72 is toothed with an input gear 71. The agitator drive gear 73 is provided in the front side of the intermediate gear 72, and is meshingly engaged with the intermediate gear 72. The developer roller drive gear 74 is positioned obliquely below the input gear 71 in the rear side of the input gear 71, and is meshingly engaged with the input gear 71. The feed roller drive gear 75 is provided below the input gear 71 and is meshingly engaged with the input gear 71. Drive force from a motor (not shown) is applied to the input gear 71.

As shown in FIG. 8, a toner filling port 76 for filling toner in a toner accommodating section 85 is formed in the left side wall 67 obliquely above the agitator drive gear 73. The toner filling port 76 is circular in shape, penetrating the left side wall 67 in the thickness direction at the position corresponding to the toner accommodating section 85. The toner filling port 76 is closed by a cap 77 for preventing toner in the toner accommodating section 85 from leaking out of the toner filling port 76.

The lower wall 69 is a plate-like member extending in the front-to-rear direction and the widthwise direction (see FIG. 7), and includes a rear lower wall portion 78 and a front lower wall portion 79. The rear lower wall portion 78 serves for partitioning a developer room 84 described later. The front lower wall portion 79 is continuous to the front end edge of the rear lower wall portion 78, and has a substantially arcuate cross-sectional shape along the rotation orbit of an agitator 87 described later. The lower wall 69 is held between the left side wall 67 and the right side wall 68.

At each of the left and right end side portions of the rear lower wall portion 78 (both side end portions in the widthwise direction), a developer engagement convex portion 80 is provided. The developer engagement convex portion 80 is inserted in insertion portions 62 of the drum cartridge 30 when the developer cartridge 31 is mounted in the drum cartridge 30. Each of the developer engagement convex portions 80 is in a substantially rectangular shape when viewed from a side. Each of the developer engagement convex portions 80 is provided outside an area through which a paper sheet 3 entering between the photosensitive drum 32 and the transfer roller 34 passes. As shown in FIG. 8, when the developer cartridge 31 is put on the flat mount surface S, the developer engagement convex portions 80 contact the mount surface S and support the developer cartridge 31 such that the upper wall 70 is substantially parallel to the mount surface S.

As shown in FIG. 2, a lower partition portion 81 having a substantially triangular cross-sectional shape and protruding upwardly is formed along the widthwise direction, at the boundary between the rear lower wall portion 78 and the front lower wall portion 79.

As shown in FIG. 6, the upper wall 70 is a plate-like member and is bridged between upper end edges of the left and right side walls 67 and 68. At the rear end portions of the upper wall 70, developer engagement concave portions 82 are formed at the left and right side end portions of the upper wall 70. When plural developer cartridges 31 are stacked one on the other, the developer engagement concave portions 82 of the lower developer cartridge are engageable with the developer engagement convex portions 80 of the upper developer cartridge 31. The developer engagement concave portion 82 in the left side is substantially rectangular in shape when viewed from the top. The concave portion 82 in left side is engaged with the lower end portion of the left developer engagement convex portion 80 of an upper developer cartridge 31 when plural developer cartridges 31 are stacked. On the other side, the right developer engagement concave portion 82 is formed in the form of a stepped portion lower in level by one step than the upper surface of the upper wall 70. The right side concave portion 82 is also engaged with the lower end portion of the right developer engagement convex portion 80 of the upper developer cartridge 31 when plural developer cartridges 31 are stacked.

As shown in FIG. 2, an upper partition plate 83 protruding downwardly is formed along the widthwise direction on the lower surface of the upper wall 70, opposed to the lower partition portion 81 of the lower wall 69.

Further, in this developer casing 63, an inner space at the front side from the upper and lower partition portions 83 and 81, is partitioned and formed as developer room 84. Another inner space at the rear side is partitioned and formed as a toner accommodating section 85.

In the toner accommodating section 85, toner made from electrically positive, non-magnetic component is accommodated as a developer. Used as the toner is polymerized toner which is obtained by a known copolymerization method by which a polymerization monomer, for example, a styrene monomer such as styrene or an acrylic monomer such as an acrylic acid, alkyl (C1 to C4) acrylate, or alkyl (C1 to C4) methacrylate are coplymerized. This kind of polymerized toner grains is spherical shape and has very excellent fluidity. Therefore, images can be formed with high image quality.

Toner of this kind is mixed with a coloring agent such as carbon-black, wax, or the like. In order to improve fluidity, an external additive agent such as silica is added. The grain diameter of the external additive agent is about 6 to 10 μm.

In the toner accommodating section 85, an agitator 87 for stirring toner in the toner accommodating section 85 is provided. At the central portion of the toner accommodating section 85, the agitator 87 is supported by an agitator rotation shaft 88 extending in the widthwise direction.

A feed roller 64 is provided in the front lower side in the developer room 84, and is rotatably supported between the left and right side walls 67 and 68 of the developer casing 63. This feed roller 64 is formed of a metal-made feed roller shaft 89, and a sponge roller 90. The feed roller shaft 89 extends in the widthwise direction. The sponge roller 90 made of an electrically conductive foaming material covers the circumference of the feed roller shaft 89.

The developer roller 65 is provided in the rear lower side in the developer room 84. The developer roller 65 and the feed roller 64 are pressed against each other. The rear portion of the developer roller 65 is partially exposed rearward from the developer casing 63. A rear part of the developer roller 65 has a metal-made developer roller shaft 91, which is covered with a rubber roller 92 made of electrically conductive rubber material, the rubber covering the circumference of the developer roller shaft 91. More specifically, the rubber roller 92 is made of electrically conductive urethane rubber or silicone rubber containing fine carbon grains. The surface of the rubber roller 92 is covered with urethane rubber or silicon rubber containing fluorine. As shown in FIGS. 6 and 7, end portions of the developer roller shaft 91 in both sides extend outwardly in the widthwise direction beyond the side plates of the developer casing 63.

As shown in FIG. 2, the layer-thickness regulation blade 66 is formed of a metal leaf spring. The layer-thickness regulation blade 66 is provided, at the top end portion thereof with a press rubber member 93 having a semi-circular cross-section made of an electrically insulating silicone rubber. Further, the layer-thickness regulation blade 66 is supported by the developer casing 63 at a position above the developer roller 65. The lower end portion of the layer-thickness regulation blade 66 is in contact with the rubber roller 92 of the developer roller 65. The press rubber member 93 is pressed against the surface of the rubber roller 92 by elastic force of the layer-thickness regulation blade 66.

Figure 10:
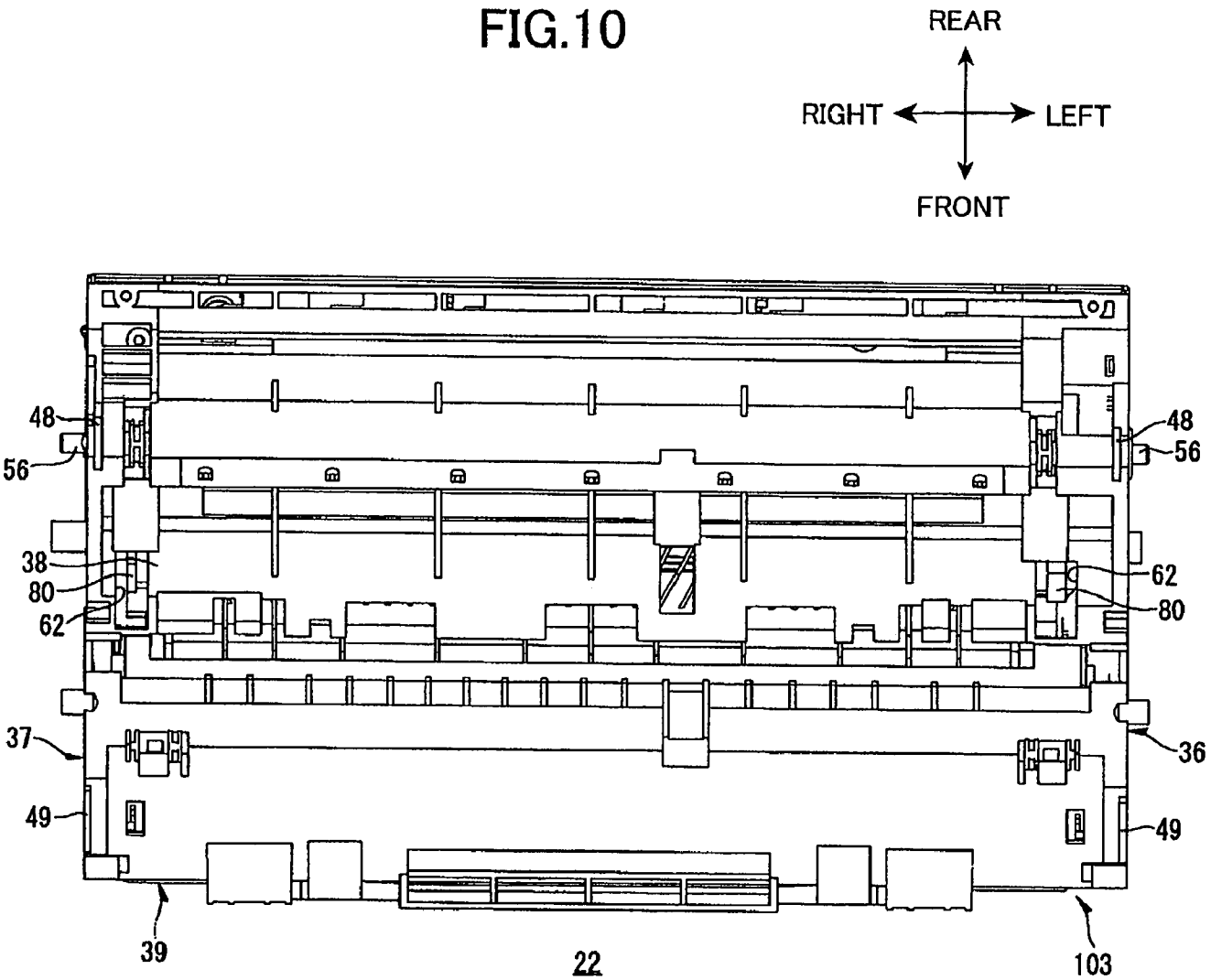
FIG. 10 is a bottom view of the process cartridge shown in FIG. 1, when the developer cartridge is mounted on the drum cartridge.

FIG. 9 is a side view of a process cartridge 22 in which the developer cartridge 31 is mounted on the drum cartridge 30. FIG. 10 is a bottom view of the process cartridge 22.

The developer cartridge 31 is attached to the developer cartridge accommodating section 54 of the drum cartridge 30 in the following manner. That is, the developer cartridge 31 is located above the developer cartridge accommodating section 54 of the drum cartridge 30. Further, both end portions of the developer roller shaft 91 protruding outwardly from both sides of the developer casing 63 are guided along the roller shaft guide portions 43 of the cartridge frame 103 of the drum cartridge 30, the developer cartridge 31 is moved down. Further, both end portions of the developer roller shaft 91 are brought into contact with the rear end edges of the roller shaft receiving portions 44, and are respectively received in the roller shaft receiving portions 44. Then, the developer cartridge 31 is completely mounted in the drum cartridge 30.

In this mounting process, the developer engagement convex portions 80 of the developer cartridge 31 are inserted in the insertion portions 62 of the drum cartridge 30, as shown in FIG. 10. Therefore, each of the developer engagement convex portions 80 does not obstruct mounting the developer cartridge 31 in the drum cartridge 30. As a result, smooth mount of the developer cartridge 31 to the drum cartridge 30 is ensured.

Referring to FIGS. 2 and 8, a drive force is applied to the input gear 71 of the developer cartridge 31. By this drive force, the agitator 87 is rotated around the agitator rotation shaft 88. Then, toner in the toner accommodating section 85 is stirred and expelled toward the developer room 84 through a section between the upper partition plate 83 and the lower partition portion 81. Further, the toner supplied to the developer room 84 is conveyed onto the developer roller 65 by the rotation of the feed roller 64. At this time, toner is frictionally positively charged when passing through a nip between the sponge roller 90 of the feed roller 64 and the rubber roller 92 of the developer roller 65. The toner supplied onto the developer roller 65 enters a nip between the developer roller 65 and the press rubber member 93 of the layer-thickness regulation blade 66 along with the rotation of the developer roller 65, thereby forming a thin toner layer having a constant thickness. The layer is carried on the developer roller 65.

Meanwhile, the surface of the photosensitive drum 32 is positively charged uniformly by the Scorotron charger 33. Thereafter, the surface of the photosensitive drum 32 is exposed to a laser beam from the scanner section 21. An electrostatic latent image based on image data is formed on the photosensitive drum 32.

Next, the positively charged toner carried on the developer roller 65 is supplied to the electrostatic latent image formed on the photosensitive drum 32. That is, of the photosensitive drum uniformly charged positively, toner is attracted to the exposed parts that have been exposed to the laser beam and have a lowered potential. Accordingly, the toner is selectively carried on the photosensitive drum 32, and the latent image is thus visualized.

The paper sheet 3 is fed between the photosensitive drum 32 and the transfer roller 34. A toner image carried on the surface of the photosensitive drum 32 is transferred to the paper sheet 3.

<Structure of Fixing Section>

As shown in FIG. 1, the fixing section 23 is provided in the rear side of the process cartridge 22 and in the downstream side in the conveying direction of the paper sheet 3. The fixing section 23 includes a heating roller 94, a press roller 95 which presses the heating roller 94, and a pair of conveyer rollers 96. The press roller 95 is opposed to the heating roller 94. The pair of conveyer rollers 96 is provided in the downstream side of the press roller 95 in the conveying direction of the paper sheet 3.

The heating roller 94 houses a halogen lamp and is made of metal for heating. In the fixing section 23, the toner image transferred to the paper sheet 3 is thermally fixed while the paper sheet 3 passes between the heating roller 94 and the press roller 95. Thereafter, the paper sheet 3 is conveyed to a sheet discharge path 97 by the conveyer rollers 96. The paper sheet 3 is discharged onto the sheet discharge tray 6 by the sheet discharge rollers 98.

In this laser printer 1, residual toner remaining on the surface of the photosensitive drum 32 after transferring the toner image to the paper sheet 3 is collected by the developer roller 65. If the toner remaining on the photosensitive drum 32 is collected by such a cleanerless method, neither a toner cleaner device nor a storage portion of waste toner are necessary. The structure of the device can thus be simplified.

<Structure of Reverse Conveyer Section>

The laser printer 1 is provided with a reverse conveyer section 99 to form images on both sides of the paper sheet 3. This reverse conveyer section 99 includes sheet discharge rollers 98, a reverse conveying path 100, a flapper 101, and plural reverse conveyer rollers 102.

The sheet discharge rollers 98 are constituted by a pair of rollers and is constructed such that forward and reverse rotations can be switched to each other. In discharging the paper sheet 3 onto the sheet discharge tray 6, the sheet discharge rollers 98 rotate in the forward direction. Otherwise, in reversing the paper sheet 3, the sheet discharge rollers 98 rotate in the reverse direction.

The reverse conveying path 100 is arranged along the vertical direction so that the paper sheet 3 can be conveyed from the sheet discharge rollers 98 to the plural reverse conveyer rollers 102 provided below the image forming position. An end portion of the reverse conveying path 100 in the upstream side is positioned near the sheet discharge rollers 98. Another end thereof in the downstream side is positioned near the reverse conveyer rollers 102.

The flapper 101 is pivotally disposed in a branch portion between the sheet discharge path 97 and the reverse conveying path 100. By energization or de-energization of a solenoid (not shown), the conveying direction can be switched from the direction toward the sheet discharge path 97 to the direction toward the reverse conveying path 100.

Plural reverse conveyer rollers 102 are provided in the front-to-rear direction, above the sheet feed tray 9. The reverse conveyer roller 102 in the most upstream side is positioned near the rear end portion of the reverse conveying path 100. The reverse conveyer rollers 102 in the most downstream side is positioned below the registration rollers 15.

Further, to form images on both sides of the paper sheet 3, this reverse conveyer section 99 is operated as follows. A paper sheet 3 having a surface on which an image has been formed is conveyed from the sheet discharge path 97 to the sheet discharge rollers 98 by the conveyer rollers 96. Then, the sheet discharge rollers 98 forwardly rotate with the paper sheet 3 sandwiched therebetween, and convey the paper sheet 3 to the outside (the side of the sheet discharge tray 6). When most part of the paper sheet 3 is fed to the outside and the rear end of the paper sheet 3 is sandwiched between the sheet discharge rollers 98, the sheet discharge rollers 98 stop rotating. Subsequently, the sheet discharge rollers 98 rotate in the reverse direction, and the flapper 101 pivots to switch the conveying direction such that the paper sheet 3 is conveyed to the reverse conveying path 100. The paper sheet 3 is conveyed to the reverse conveying path 100 with the top and bottom of the paper sheet 3 reversed. After conveyance of the paper sheet 3 is completed, the flapper 101 is switched to an original state, i.e., a state in which the paper sheet 3 fed from the conveyer rollers 96 is sent to the sheet discharge rollers 98.

Subsequently, the paper sheet 3 conveyed to the reverse conveying path 100 in the opposite direction is further conveyed to the reverse conveyer rollers 102. From the reverse conveyer rollers 102, the paper sheet 3 is conveyed upwardly and further reversed, and sent to the registration rollers 15. The paper sheet 3 conveyed to the registration rollers 15 is subjected to registration again. Thereafter, the paper sheet 3 is fed to the image forming position. Images are thus formed on both sides of the paper sheet 3.

<Stacking of Process Cartridges>

Figure 11:
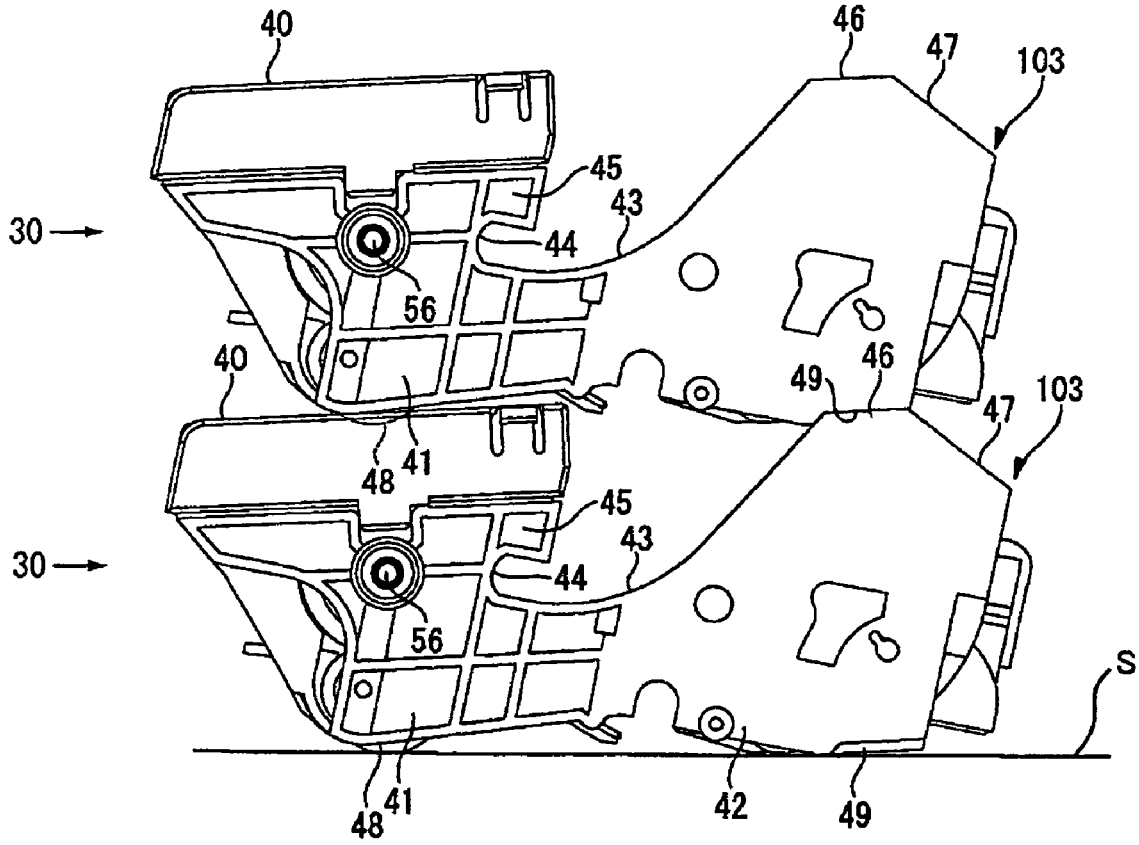
FIG. 11 is a side view of the process cartridge shown in FIG. 1, when the drum cartridges are stacked.
Figure 12:
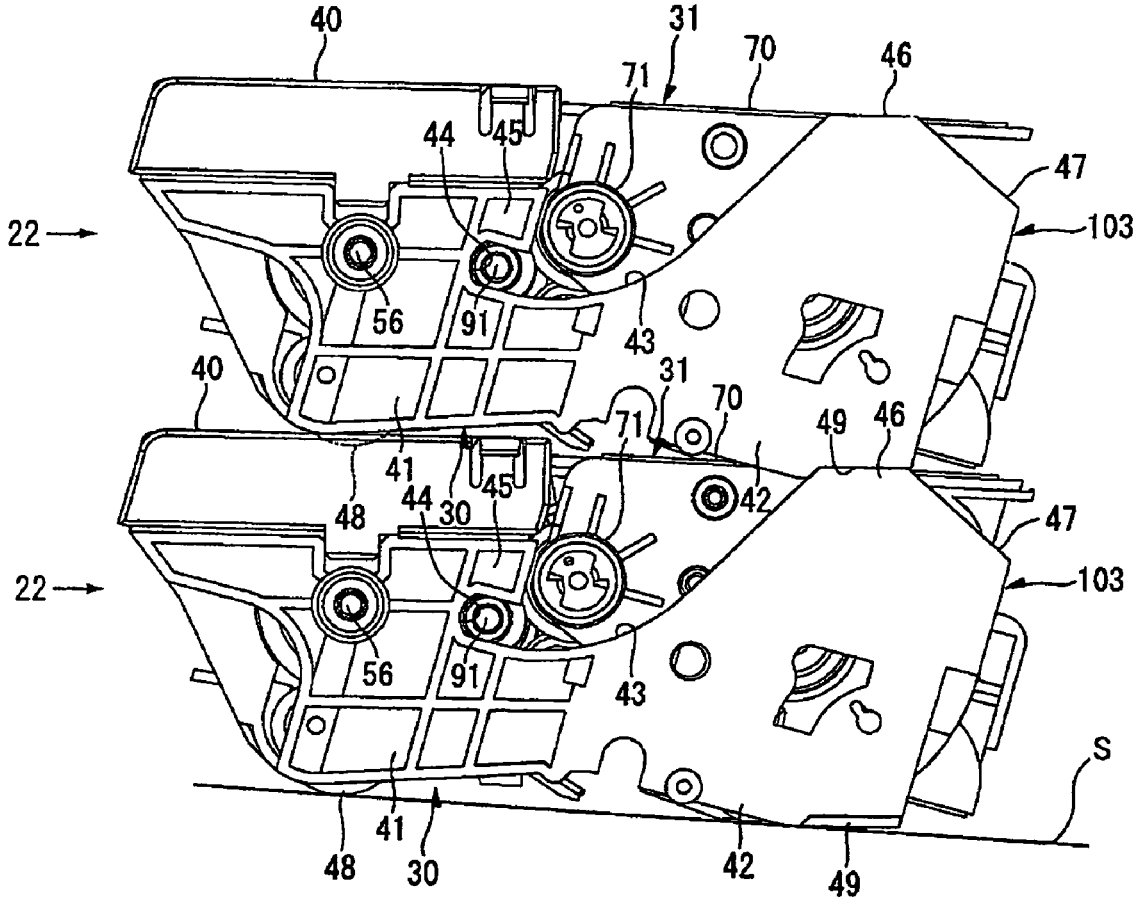
FIG. 12 is a side view of stacked process cartridges each shown in FIG. 1, when each developer cartridge is mounted on the drum cartridge.
Figure 13:
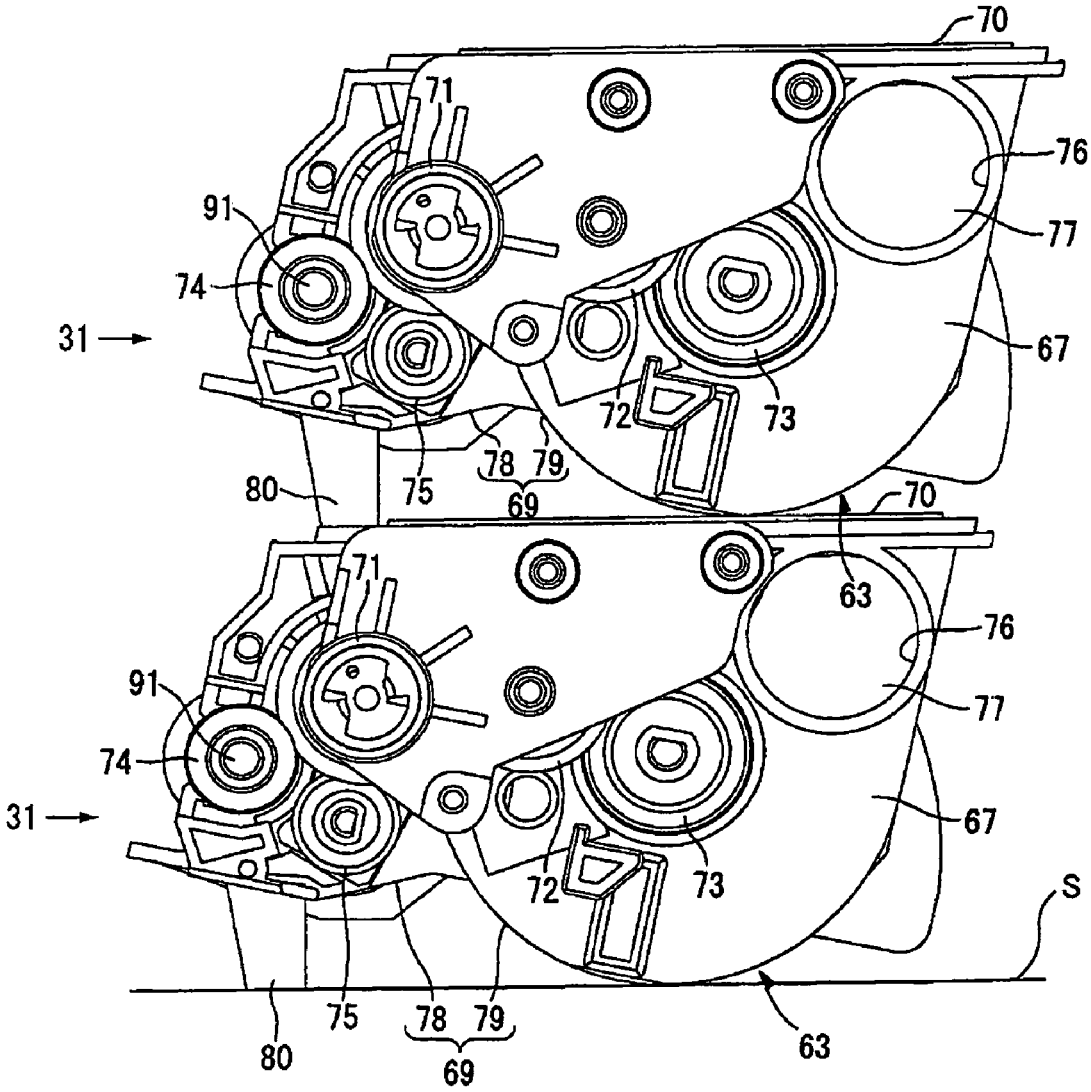
FIG. 13 is a side view of stacked developer cartridges each shown in FIG. 1.

FIG. 11 is a side view showing a state in which two drum cartridges 30 are stacked. FIG. 12 is a side view showing a state in which developer cartridges 31 are mounted in the drum cartridges 30. FIG. 13 is a side view showing a state in which two developer cartridges 31 are stacked.

According to the structure as described above, the rear engagement convex portions 48 are formed on the bottom wall 38 of the cartridge frame 103 of the drum cartridge 30. Formed on the rear upper wall 40 are the rear engagement concave portions 52 engageable with the rear engagement convex portion 48. The front engagement concave portions 49 are also formed on the bottom wall 38. Formed on the front side wall portions 42 of the left and right side walls 36 and 37 are the front engagement convex portions 46 each being engageable with the front engagement concave portion 49. Therefore, another drum cartridge 30 is provided on a drum cartridge 30 as shown in FIG. 11, or another process cartridge 22 is provided on a process cartridge 22 as shown in FIG. 12. Then, the rear engagement convex portions 48 of the upper drum cartridge 30 (process cartridge 22) can be engaged with the rear engagement concave portions 52 of the lower drum cartridge 30 (process cartridge 22). Simultaneously, the front engagement concave portions 49 of the upper drum cartridge 30 (process cartridge 22) can be engaged with the front engagement convex portions 46 of the lower drum cartridge 30 (process cartridge 22). Likewise, another drum cartridge 30 (process cartridge 22) may be stacked on the upper drum cartridge 30 (process cartridge 22), may be stacked on the upper drum cartridge 30 (process cartridge 22). Then, the rear engagement convex portions 48 and the front engagement concave portions 49 of the upper drum cartridge 30 (process cartridge 22) can be engaged with the rear engagement concave portion 52 and the front engagement convex portion 46 of the lower drum cartridge 30 (process cartridge 22) respectively.

As a result, plural drum cartridges 30 can be stacked stably by concave-convex engagement between the individual drum cartridges 30. When drum cartridges 30 are detached from the laser printer 1 (body casing 2), the drum cartridges 30 can be handled easily. In addition, the space for storing the drum cartridge 30 can be reduced.

Also, plural process cartridges 22 can be stacked stably by concave-convex engagement between the individual process cartridges 22. When process cartridges 22 are detached from the laser printer 1 (body casing 2), the process cartridges 22 can be handled easily. And, the space for storing the process cartridge 22 can be reduced.

As shown in FIG. 4, the rear engagement convex portions 48, front engagement concave portions 49, rear engagement concave portions 52, and front engagement convex portions 46 are provided in both the left and right sides (both sides in the widthwise direction). Therefore, by concave-convex engagement between these portions, plural drum cartridges 30 can be stacked more stably. Similarly, by concave-convex engagement between these portions, plural process cartridges 22 can be stacked more stably.

In addition, when a drum cartridge 30 (see FIG. 5) or a process cartridge 22 (see FIG. 9) is put on the flat mount surface S, each of the rear engagement convex portions 48 contacts the mount surface S, and supports the drum cartridge 30 or process cartridge 22 such that the rear upper wall 40 and the front engagement convex portion 46 are substantially parallel to the mount surface S. On the drum cartridge 30 put on the mount surface S, plural drum cartridges 30 can be stacked much more stably. Similarly, on the process cartridge 22 put on the mount surface S, plural process cartridges 22 can also be stacked much more stably.

The rear engagement concave portions 52 and the front engagement convex portions 46 are at such positions that are opposed to the rear engagement convex portions 48 and the front engagement concave portions 49 in the vertical direction. Therefore, plural drum cartridges 30 can be stacked in the vertical direction. As a result, the plural drum cartridges 30 can be stacked more stably. Similarly, plural process cartridges 22 can be stacked in the vertical direction. As a result, the plural process cartridges can be stacked more stably.

Further, the rear engagement concave portions 52 and the front engagement convex portions 46 are spaced apart therebetween in the front-to-rear direction. The rear engagement convex portions 48 and the front engagement concave portions 49 are space apart therebetween in the front-to-rear direction.

Therefore, the state in which plural drum cartridges 30 are stacked can be kept more stably in the front-to-rear direction, by concave-convex engagement between the respective cartridges. As a result, plural drum cartridges 30 can be stacked more stably.

Also, the state in which plural process cartridges 22 are stacked can be kept more stably in the front-to-rear direction, by concave-convex engagement between the respective cartridges. As a result, plural process cartridges 22 can be stacked more stably.

In other words, the rear engagement concave portion 52 and the rear engagement convex portions 48 which are opposed to each other in the vertical direction are considered as one set. The front engagement convex portion 46 and the front engagement concave portion 49 which are opposed to each other in the vertical direction are considered as one set. These sets spaced apart in the front-to-rear direction. For each set, two sets are provided in the widthwise direction. Therefore, in the front-to-rear direction and in the widthwise direction, the plural drum cartridges 30 can be stacked one on the other, kept stable in the vertical direction. Similarly, in the front-to-rear direction and in the widthwise direction, the plural process cartridges 30 can be stacked one on the other, kept stable in the vertical direction.

In the present embodiment, as shown in FIG. 9, when the developer cartridge 31 is mounted on the developer cartridge accommodating section 54 of the drum cartridge 30, and these cartridges are put on the mount surface S, a height from the mount surface S to the upper surface (the upper wall 70) of the developer casing 63 of the developer cartridge 31 is substantially equal to the height from the mount surface S to the upper surface of the rear upper wall 40. As shown in FIG. 12, when the developer cartridge 31 is mounted on the drum cartridge 30, the plurality of process cartridge 22 (the drum cartridge with the developer cartridge) can be stacked stably.

As shown in FIG. 8, the developer cartridge 31 is provided with the developer engagement convex portions 80. When the developer cartridge 31 is put on a flat mount surface S, the developer engagement convex portions 80 contact the mount surface S and support the developer cartridge 31 such that the upper wall 70 of the developer casing 63 is substantially parallel to the mount surface S. Therefore, as shown in FIG. 13, another developer cartridge 31 can be stacked on a developer cartridge 31 put on the mount surface S.

In addition, the developer engagement convex portions 80 are provided in both the left and right sides of the developer cartridge 31. When the developer cartridge 31 is put on a mount surface S, the upper wall 70 of the developer casing 63 substantially parallel to the mount surface S in the widthwise direction. Therefore, another developer cartridge 31 can be stacked stably on the developer cartridge 31 put on the mount surface S.

The insertion portions 62 are formed in the drum cartridge 30. When the developer cartridge 31 is mounted on the drum cartridge 30, the developer engagement convex portions 80 are inserted in the corresponding insertion portions 62. Therefore, the developer engagement convex portions 80 are prevented from obstructing mounting of the developer cartridge 31 in the drum cartridge 30. As a result, smooth mounting of the developer cartridge 31 to the drum cartridge 30 can be ensured.

Besides, each of the insertion portions 62 is provided outside the area through which the paper sheet 3 entering between the photosensitive drum 32 and the transfer roller 34 passes. Therefore, when the developer cartridge 31 is mounted on the drum cartridge 30, the developer engagement convex portions 80 inserted in the corresponding insertion portions 62 are prevented from obstructing passage of the paper sheet 3.

In addition, the developer engagement concave portions 82 each being engageable with the developer engagement convex portion 80 are formed in the upper wall 70 of the developer casing 63 of the developer cartridge 31. Therefore, when developer cartridge 31 can be put on the developer cartridge 31, the developer engagement convex portions 80 of the upper developer cartridge 31 can be engaged with the developer engagement concave portions 82 of the lower developer cartridge 31. Likewise, when further developer cartridge 31 can be put on the upper developer cartridge 31, and the developer engagement convex portions 80 of the upper developer cartridge 31 can be engaged with the developer engagement concave portions 82 of the lower developer cartridge 31. As a result, plural developer cartridges 31 can be put, stacked stably, by engaging the developer engagement convex portions 80 with the corresponding developer engagement concave portions 82. Therefore, when developer cartridges 31 are put out of the laser printer 1 (body casing 2), handling of the developer cartridges 31 can be facilitated. In addition, the space for storing the developer cartridges 31 can be reduced.

The developer cartridge 31 has a toner accommodating section 85 for accommodating toner. When the developer cartridge 31 is mounted on the drum cartridge 30, the developer cartridge 31 can supply the photosensitive drum 32 supported by the drum cartridge 30 with the toner accommodated in the toner accommodating section 85.

The laser printer 1 has a drum cartridge 30 (process cartridge 22) and a developer cartridge 31 as described above. Therefore, in case where the manufacturer of the laser printer 1 recycles process cartridges 22, handling of drum cartridges 30 and developer cartridges 31 is facilitated. In addition, the space for storing the drum cartridges 30 and developer cartridges 31 can be reduced.

While the invention has been described in detail with reference to the specific embodiment thereof, it would be apparent to those skilled in the art that various changes and modifications may be made therein without departing from the spirit of the invention.

What is claimed is:

1. A developer cartridge, detachably mountable in an image-bearing member cartridge formed with two insertion portions, the developer cartridge comprising:

a first developer wall defining a lower surface of the developer cartridge and being provided with:

two convex parts protruding downward and that are arranged in a first direction, each of the two convex parts providing a first lowermost area of the developer cartridge;

a guide portion located between the two convex parts with respect to the first direction, the guide portion being configured for guiding a recording medium when the recording medium moves between the two convex parts in a second direction perpendicular to the first direction; and a curved surface that protrudes downward and that provides a second lowermost area of the developer cartridge; and a second developer wall exclusively defining an upper surface of the developer cartridge;

wherein:

when the developer cartridge is put on a flat surface with the first developer wall facing downward, the two first lowermost areas and the second lowermost area contact the flat surface so as to support the developer cartridge; and the two convex parts are insertable into the two insertion portions when the developer cartridge is mounted on the image-bearing member cartridge.

2. The developer cartridge as claimed in claim 1, wherein the second developer wall has a flat surface part; and an imaginary plane connecting the first lowermost area to the second lowermost area is parallel to the flat surface part.

3. The developer cartridge as claimed in claim 2, wherein the second developer wall has two concave surface parts, wherein when a plurality of the developer cartridges are stacked one on the other with the first developer wall being downside with respect to the second developer wall, the two convex parts in one developer cartridge engage the two concave surface parts in another developer cartridge disposed just below the one developer cartridge.

4. The developer cartridge as claimed in claim 1, wherein the developer cartridge supplies a toner to an image-bearing member supported by the image-bearing member cartridge.

5. The developer cartridge as claimed in claim 1, wherein the two convex parts and the curved surface define an imaginary plane, wherein the second developer wall has an outer surface, wherein the imaginary plane is substantially parallel with the outer surface of the second developer wall.

6. A developer cartridge, detachably mountable in an image-bearing member cartridge, the developer cartridge comprising a developer main casing comprising:

a first developer wall defining a lower surface of the developer cartridge and being provided with:

two first developer engagement parts that protrude downward and that are arranged in a first direction, each of the two first developer engagement parts defining a first lowermost area of the developer cartridge;

a guide portion that is located between the two first developer engagement parts with respect to the first direction, the guide portion being configured for guiding a recording medium when the recording medium moves between the two convex parts in a second direction perpendicular to the first direction;

a curved surface that protrudes downward and that provides a second lowermost area of the developer cartridge; and a second developer wall exclusively defining an upper surface of the developer cartridge and being provided with two second developer engagement parts;

wherein:

when the developer cartridge is put on a flat surface with the first developer wall facing downward, the first lowermost area and the second lowermost area contact the flat surface; and when a plurality of the developer cartridges are stacked one on the other with the first developer wall being downside with respect to the second developer wall facing upward, the two first developer engagement parts in one developer cartridge engage the two second developer engagement parts in another developer cartridge disposed just below the one developer cartridge.

7. The developer cartridge as claimed in claim 6, wherein the developer cartridge supplies a toner to an image-bearing member supported by the image-bearing member cartridge.

8. An image-forming device comprising a developer cartridge, detachably mountable in an image-bearing member cartridge formed with two insertion portions, the developer cartridge comprising:

a first developer wall defining a lower surface of the developer cartridge and being provided with:

two convex parts protruding downward and that are arranged in a first direction, each of the two convex parts providing a first lowermost area of the developer cartridge; and a guide portion located between the two convex parts with respect to the first direction, the guide portion being configured for guiding a recording medium when the recording medium moves between the two convex parts in a second direction perpendicular to the first direction; and a curved surface that protrudes downward and provides a second lowermost area of the developer cartridge; and a second developer wall exclusively defining an upper surface of the developer cartridge;

wherein:

when the developer cartridge is put on a flat surface with the first developer wall facing downward, the first lowermost area and the second lowermost area contact the flat surface so as to support the developer cartridge; and the two convex parts are insertable into the two insertion portions when the developer cartridge is mounted on the image-bearing member cartridge.

9. A developer cartridge comprising:

a first developer wall formed defining a lower surface of the developer cartridge and provided with:

two convex parts protruding downward and that are arranged in a first direction, each of the two convex parts providing a first lowermost area of the developer cartridge:

a guide portion located between the two convex parts with respect to the first direction, the guide portion being configured for guiding a recording medium when the recording medium moves between the two convex pads in a second direction perpendicular to the first direction; and curved surface protruding downward and providing a second lowermost area of the developer cartridge; and a second developer wall exclusively defining an upper surface of the developer cartridge and having a flat surface part; and wherein:

when the developer cartridge is put on a flat surface with the first developer wail facing downward, the first lowermost areas and the second lowermost area contact the flat surface; and an imaginary plane connecting the first lowermost area to the second lowermost area is parallel to the flat surface part.

10. The developer cartridge as claimed in claim 9, wherein the second developer wall has two concave surface parts, wherein when one developer cartridge is stacked on another developer cartridge with the first developer wall of the one developer cartridge being downside with respect to the second wall of the one developer cartridge and with the first developer wall of the another developer cartridge being downside with respect to the second developer wall of the another developer cartridge, the two convex parts of the one developer cartridge engages two concave surface parts of the another developer cartridge disposed just below the one developer cartridge.

11. The developer cartridge as claimed in claim 9, wherein the first developer wall has at least two edges along which each of the two convex parts is formed.

* * * * *